US005251344A

United States Patent [19]

Blomet

[11] Patent Number: 5,251,344

[45] Date of Patent: Oct. 12, 1993

[54] TANK FOR STERILE, PORTABLE, SELF-CONTAINED SHOWER AND SHOWER EQUIPPED THEREWITH

[75] Inventor: Joël Blomet, Valmondois, France

[73] Assignee: Prevor International, France

[21] Appl. No.: 789,847

[22] Filed: Nov. 12, 1991

[30] Foreign Application Priority Data

Nov. 9, 1990 [FR] France ..... 90 13926

[51] Int. Cl.[5] ..... A47K 3/22

[52] U.S. Cl. ..... 4/602; 4/616; 222/386.5

[58] Field of Search ..... 4/596, 599, 602, 603, 4/615, 616; 222/386.5, 399, 464; 169/73; 141/10

[56] References Cited

U.S. PATENT DOCUMENTS

| | | | |
|---|---|---|---|
| 2,557,162 | 6/1951 | Wetzel et al. | 169/73 |
| 2,738,227 | 3/1956 | Havens | 222/386.5 |
| 3,178,075 | 4/1965 | Riedl et al. | 222/386.5 |
| 3,240,399 | 3/1966 | Frandeen | 222/211 |
| 4,043,510 | 8/1977 | Morris | 239/323 |
| 4,159,790 | 7/1979 | Bailey | 222/386.5 X |
| 5,085,345 | 2/1992 | Wells | 222/386.5 X |

FOREIGN PATENT DOCUMENTS

| | | |
|---|---|---|
| 2638966 | 5/1990 | France . |
| 1337792 | 11/1973 | United Kingdom . |

*Primary Examiner*—Henry J. Recla
*Assistant Examiner*—Robert M. Fetsuga
*Attorney, Agent, or Firm*—Larson and Taylor

[57] ABSTRACT

A tank for a sterile, portable, self-contained shower having an elongated tank body which has an end opening and containing a washing liquid within a single sterile pocket and which is sealingly connected to an outlet opening of the tank and including a carriage with a propulsive compressed gas which is releasable outside of the cartridge. The sterile pocket is elongated with a generally circular cross section and which has a length preferably several times longer than the length of the elongated tank body. The sterile pocket extends in a zig-zag pattern inside of the tank. A tube extends inside of the sterile pocket over a substantial portion of its length and is connected with an outlet opening from the pocket which connects with the outlet opening of the tank.

12 Claims, 1 Drawing Sheet

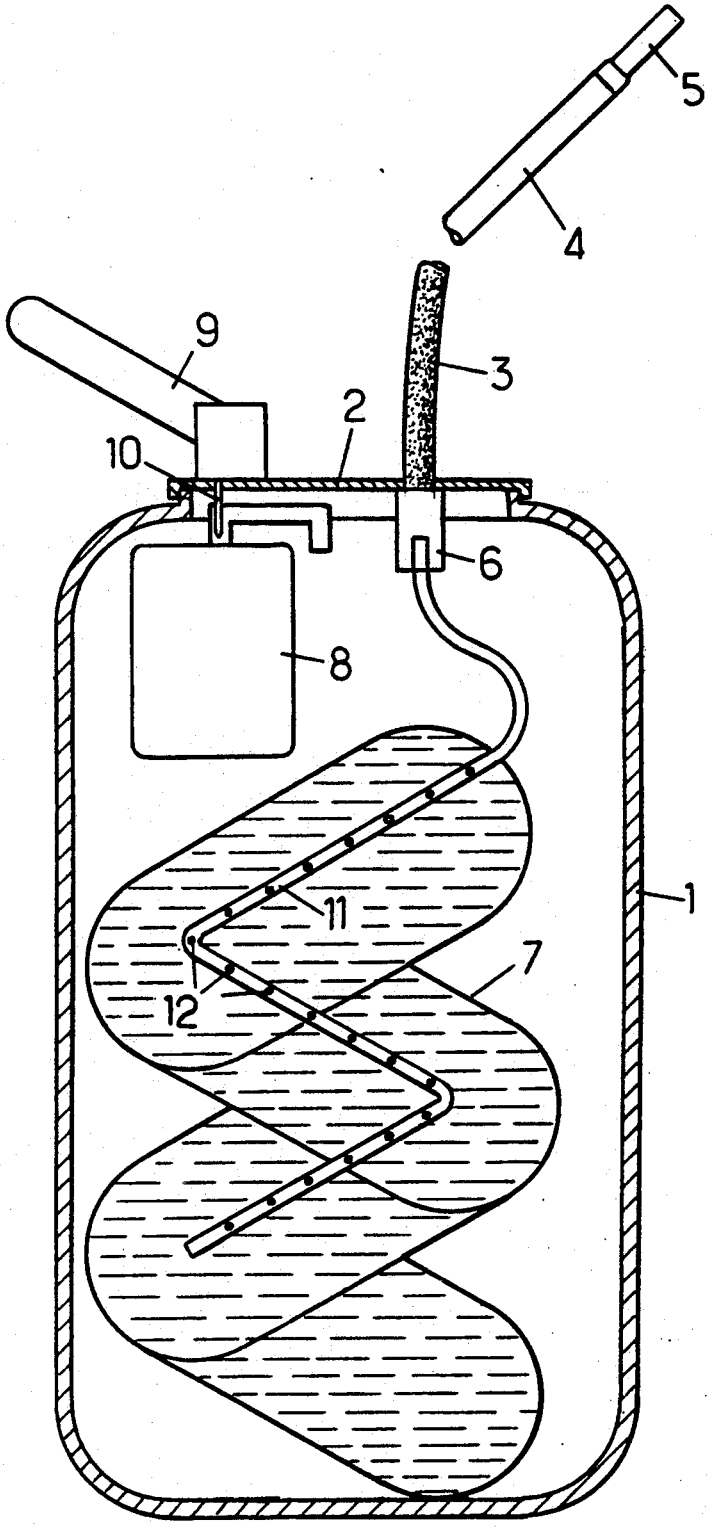
5
4
9
3
2
10
6
8
1
11
7
12

TANK FOR STERILE, PORTABLE, SELF-CONTAINED SHOWER AND SHOWER EQUIPPED THEREWITH

The present invention generally concerns sterile portable, self-contained showers, in which a tank contains a washing liquid included in a sterile pocket connected with the tank outlet which is sealed by a removable plug, a propulsive compressed gas cartridge and means for releasing the compressed gas out of the cartridge. The invention more particularly concerns improvements made to the tanks with which such showers are equipped.

Showers of the aforesaid type are particularly known by the patent application FR-A-2 638 966 in the name of the Applicant. It should briefly be reminded that, during the operation of such a shower, the release of the compressed gas contained in the cartridge (e.g. by piercing thereof) causes the pocket containing the washing liquid to be crushed, resulting in the automatic ejection of the closing plug and in the propulsion of the liquid into a diffusing organ disposed for example on the end of a lance.

Although the showers of this design operate satisfactorily, their manufacturing however gives rise to some drawbacks, more specifically as regards the manufacture of the tank.

In fact, it had been provided, when manufacturing such portable showers, to use, as tank bodies, those bodies found in fire extinguisher tanks or of an analogous type, which feature interesting qualities with regard to weight and portability, operability and mechanical resistance.

Some attempts were made with a view to housing the washing liquid in a single pocket occupying a maximum of space available inside the body of the tank. However, it proved extremely difficult to introduce such a single pocket of a conventionally square or rectangular section (for example 150 mm×260 mm) through an opening with a standardized dimension (diameter of about 60 mm) mounted in the upper part of the fire extinguisher body; and when after much trouble the pocket could finally be positioned, it often appeared that the pocket was folded back and, when put under pressure, such a fold prevented one part of the liquid to be propulsed towards the outside. The result was a poor operation of the shower: either the quantity of the washing liquid distributed was insufficient or the pressure of the part of the liquid in contact with the plug remained too low to be able to eject said plug, and the shower was no longer in a position to operate.

Attempts were then made in order to obviate these difficulties by disposing inside the body of the tank several pockets having a lesser volume interconnected by pipes. However, here again, it proved difficult to house the whole of the connection pipes in the space made available for this purpose in the body of the tank; besides, during starting-up, the putting under pressure of the washing liquid about to be propulsed to the outside could result in a twisting and/or folding of these pipes giving rise to a considerable decrease in the cross-section for the flow of the liquid, even to the total plugging thereof.

The essential object of the invention is therefore to remedy the aforesaid drawbacks and to suggest an improved tank arrangement for such showers capable of better meeting the various requirements encountered in the practice, and which in particular are easier to mount and are more reliable.

With these ends in view, a tank intended for a sterile, portable, self-contained shower such as described in the above introduction is essentially characterized in that in the arrangement according to the invention the single sterilized pocket has the shape of an elongated sausage with a cross-section of approximately the same dimension as the dimension of an opening of a tank body and a length several times longer than the height of the tank body, which extends in a zigzag pattern inside the tank and in that a tube shaped element extends inside the pocket over a substantial length thereof and is connected with an outlet opening of that pocket which is in communication with the outlet orifice of the tank.

The pocket is therefore manufactured in a single shape which eliminates some of the drawbacks encountered with multiple pockets, and at the same time the elongated sausage shape given to this pocket makes it possible to easily introduce same through the upper opening of the tank body (for example, the sausage-shaped pocket may have a diameter of about 60 mm which approximately corresponds to the diameter of said opening). Moreover, in view of its very elongated shape (the pocket may have a length from 4 to 8 times the height of the tank body), the pocket not completely filled with a liquid (for example filled to about 55%) may assume a folded back configuration (for example as a zigzag folding) inside the tank body so as to occupy the maximum of volume available inside the latter. Finally, in order to eliminate the difficulties associated with the foldings of a pocket, a tube-shaped element is placed inside the pocket, preferably a flexible or semi-flexible and non-crushable element, which is connected with the outlet of the pocket (which is in communication with the outlet of the tank), which tube-shaped element extends over the substantial length of the pocket (for example the three quarters of this length) and thus prevents the buildup of total foldings of the pocket likely to isolate part of the liquid and prevent its discharge, or at the very least, even if one or several foldings of the pocket occur, it is possible, by means of a suitable arrangement of a tube-shaped element as indicated hereafter, to obtain the complete discharge of the liquid.

In practice, in a preferred embodiment, the tube-shaped element is provided with a plurality of piercings distributed over its whole length, which facilitates the discharge of the liquid during the expulsion and besides makes it possible to discharge all of the liquid even in the case when the pocket is folded back on itself and builds up cavities which isolate the liquid. Besides, simpler still, the tube-shaped element can be made to sealingly cross the wall of a pocket and be extended up to the outlet orifice of the tank with which it is connected, a tube-shaped element thus equally constituting the outlet organ for the liquid outside of the pocket and the connection with the outlet of the tank.

The invention will be better understood from the following detailed description of a preferred embodiment given as a purely exemplary illustration. In this description reference is made to the enclosed drawing in which the only Figure is a diagrammatial cross-section of a sterile, portable, self-contained shower equipped with a tank arranged in accordance with the invention.

The portable shower represented in the drawing includes a tank body 1 of the type used in fire extinguishers or of an analogous type, having on its upper part an opening closed by a shutter 2.

This shutter 2 externally supports a flexible tube 3 forming a lance or ended by a lance 4, which is equipped with a diffuser 5. Internally the shutter 2 supports, in communication with the flexible tube 3, a connection 6 containing a removable plug (not represented); connection 6 communicates with a flexible pocket 7 containing a washing liquid.

The shutter 2 equally supports, internally, a cartridge 8 containing a compressed gas and, externally, an actuator (handle) 9 capable of displacing a perforating organ (needle) 10 located opposite the wall of cartridge 8.

The pocket 7 is constructed in the shape of an elongated sausage having a diameter corresponding approximately to the opening diameter of the tank body 1 and having a length corresponding to several times (for example 4 to 8 times) the height of the tank body 1. Thus, in a typical example, in order to mount a tank body having a height of 600 mm and having an opening of 60 mm in diameter, the pocket will have a diameter of approximately 60 mm and a length of about 3.20 m.

This pocket is only partially filled with a liquid (for example, approximately 55%) so that it may extend in a sinuous pattern and be partly folded back upon itself inside the tank body and also be filled up to the maximum of its internal volume. Thus, the pocket can be folded back upon itself in a zigzag pattern as shown in the Figure or be helically wound on itself.

Whatever the configuration assumed by the pocket, inside said pocket a tube 11 in a flexible or semi-flexible but non-crushable material, which, sealingly crossing the wall of a pocket 7 is linked with a connection 6. The tube 11 extends over a substantial length (for example the three quarters, that is approximately 2.40 m in the aforesaid example of the pocket 7 and is provided with a plurality of perforations 12 (only in the inside of the pocket). Therefore, the whole volume of liquid contained in the pocket is capable of being discharged even if the buildup of foldings should prevent the normal expulsion of certain isolated parts of the liquid mass. Moreover, a better transmission of the pressure through the liquid mass up to the shutter plug contained in the connection 6 can be obtained as well as the proper ejection of said plug.

In all respects, the operation of the shower is improved and made more reliable and at the same time the mounting of the apparatus is made simpler, faster and therefore less costly.

As goes without saying and as results besides already from the foregoing the invention is in no way limited to those of its application modes and embodiments which have more particularly been envisaged; it embraces on the contrary all of its variants.

I claim:

1. A tank for a sterile portable self-contained shower, comprising:

an elongated tank body having an end opening and containing a single, flexible sterile pocket which contains a washing liquid therein, said tank having a shutter sealing said end opening, said shutter having a tank outlet opening, the inside of the sterile pocket having a connection to said tank outlet opening, a cartridge located in the tank having a compressed propulsive gas and including means for releasing the compressed propulsive gas out from the cartridge into the tank body, the sterile pocket being elongated and generally circular in cross section, the cross section being small enough to fit through the said end opening and substantially less than the cross section of the tank body itself, the length of the sterile pocket, in its elongated direction being at least several times the length of the tank body, said sterile pocket being positioned in the tank in a configuration wherein the elongated sterile pocket is folded upon itself so as to take up within the tank body a length which is substantially less than the total length of the unfolded sterile pocket, and a tube extending in the sterile pocket over a substantial portion of its length, said tube forming the connection to the said tank outlet opening.

2. A tank according to claim 1, wherein the cross section of the sterile pocket is substantially the same as the cross section of the said end opening.

3. A tank according to claim 1, wherein the tube is at least partially flexible.

4. A tank according to claim 1, wherein the tube has a plurality of perforations distributed over its length.

5. A tank according to claim 4, wherein the tube sealingly crosses a wall of the sterile pocket and extends to the said outlet opening of the tank.

6. A tank according to claim 1, wherein the tube has a length corresponding approximately to three quarters of the length of the sterile pocket.

7. A tank according to claim 1, wherein the sterile pocket has a length corresponding to approximately 4 to 8 times the length of the tank body.

8. A tank according to claim 1, wherein the tank body is a fire extinguisher tank and wherein the pocket is introducible into the tank body through said end opening thereof.

9. A tank according to claim 8, wherein the tank body has a height of approximately 600 mm and wherein the sterile pocket has a length in its unfolded state of approximately 3.2 m and has a diameter of approximately 60 mm.

10. A tank according to claim 1, wherein the sterile pocket is positioned in the tank folded back and forth in a zig-zag configuration so as to maximize the volume available within the tank taken up by the sterile pocket.

11. A tank according to claim 10, wherein the end opening is less than the cross section of the tank body and the sterile pocket cross section is substantially similar to the cross section of the said end opening.

12. A sterile portable self-contained shower comprising a pressurized tank containing a washing liquid and having a lance provided with a diffuser in fluid communication with said washing liquid for propelling the washing liquid towards the exterior of the tank, wherein the tank and washing liquid are constituted according to claim 1.

* * * * *